US007604133B2

(12) United States Patent
Tsai

(10) Patent No.: US 7,604,133 B2
(45) Date of Patent: Oct. 20, 2009

(54) STORAGE RACK

(75) Inventor: Ritter Tsai, Changhua Hsien (TW)

(73) Assignees: Huei Tyng Enterprise Co., Ltd., Changhua Hsien (TW); Edifice Co., Ltd., Taipei (TW)

( * ) Notice: Subject to any disclaimer, the term of this patent is extended or adjusted under 35 U.S.C. 154(b) by 301 days.

(21) Appl. No.: 11/733,138

(22) Filed: Apr. 9, 2007

(65) Prior Publication Data

US 2008/0223799 A1 Sep. 18, 2008

(30) Foreign Application Priority Data

Mar. 16, 2007 (TW) ..... 96204276 U

(51) Int. Cl.
*A47F 5/00* (2006.01)

(52) U.S. Cl. ..... 211/194; 211/189

(58) Field of Classification Search ..... 211/182, 211/198, 189, 194, 134, 186, 188; 312/111, 312/107, 108; 108/180; 403/169, 171, 176, 403/218

See application file for complete search history.

(56) References Cited

U.S. PATENT DOCUMENTS 3,462,893 A * 8/1969 Kaiser ..... 52/81.3
3,528,559 A * 9/1970 Miller ..... 211/195
4,021,127 A * 5/1977 Gasparro et al. ..... 403/171
4,065,220 A * 12/1977 Ruga ..... 403/169
4,161,375 A * 7/1979 Murphy ..... 403/169
4,493,425 A * 1/1985 Yoshida ..... 211/189
4,516,376 A * 5/1985 King ..... 52/655.1
4,678,359 A * 7/1987 Keen ..... 403/170
4,915,532 A * 4/1990 Radclyffe ..... 403/171
5,074,094 A * 12/1991 Gassler ..... 52/655.2
5,529,423 A * 6/1996 Burke et al. ..... 403/218
5,715,956 A * 2/1998 Yoshida ..... 211/182
5,791,806 A * 8/1998 Giehl ..... 403/117
5,797,695 A * 8/1998 Prusmack ..... 403/170
5,918,998 A * 7/1999 Pourmand ..... 403/218
5,997,117 A * 12/1999 Krietzman ..... 312/265.4
6,332,657 B1 * 12/2001 Fischer ..... 312/111
6,564,953 B2 * 5/2003 Ascik ..... 211/189
7,296,699 B2 * 11/2007 Hung et al. ..... 211/189
2005/0006991 A1 * 1/2005 Saravis ..... 312/111
2006/0278777 A1 * 12/2006 Atkinson et al. ..... 248/188.4

OTHER PUBLICATIONS

Taiwanese Patent No. TW M276490, pp. 6.

* cited by examiner

*Primary Examiner*—Jennifer E. Novosad
(74) *Attorney, Agent, or Firm*—Alan Kamrath; Kamrath & Associates PA

(57) ABSTRACT

A storage rack includes a plurality of connecting members and wall sections. Each connecting member includes a hexagonal base from which three engaging portions defining an engaging end project for allowing wall sections to be joined. The engaging portions are equally spaced on the base and each includes a bottom and three engaging fins. The engaging fins include engaging slots defined therebetween. Each wall section includes a sheet and a frame. The sheet and the frame include a bend defined therein. The sheet includes a plurality of folded sections formed therein. The wall section is received in the engaging slot. The connecting members and wall sections can be implemented to form a plurality of hexagonal storage rooms.

8 Claims, 6 Drawing Sheets

STORAGE RACK

BACKGROUND OF THE INVENTION

1. Field of the Invention

The present invention relates to a storage rack, in particular, to a storage rack that is possessed of a sturdy structure.

2. Description of the Related Art

Referring to Taiwan Pat. No. M276490, a storage rack using modular components includes a plurality of wall sections 10 and connecting members 20. Each connecting member 20 is formed with a base 21 from which two laterally spaced ribs 23 and two longitudinally spaced ribs 24 project for allowing a frame 12 of the wall section 10 to be engaged horizontally or vertically. The ribs 23, 24 are intercrossed so that two longitudinal positioning slots and two lateral positioning slots are defined. Each positioning slot has a plurality of groove sections 26 defined thereover. When one of the wall sections 10 is received in one of the positioning slots, the metal frame 12 adjacent to a corner is engaged with the groove section 26 of the positioning slot of the connecting member 20. The frame 12 is covered by a plastic sheet 11, but the plastic sheet 11 does not extend to the corners. However, a cylindrical object to be stored in this system can easily trundle or even fall out as the surface supporting the body of the object is horizontal. Another drawback of the rack is that each of the connecting members 20 contacting the floor has only one point of contact, so the structure is not strong enough to support the weight of a large number of such objects. Furthermore, as the wall sections 10 are assembled at right angles to each other for an individual square storage room, the structure of the system is believed not sturdy in use.

The present invention is, therefore, intended to obviate or at least alleviate the problems encountered in the prior art.

SUMMARY OF THE INVENTION

A storage rack includes a plurality of connecting members and wall sections. Each, connecting member includes a hexagonal base from which three engaging portions defining an engaging end project for allowing wall sections to be joined. The engaging portions are equally spaced on the base and each includes a bottom and three engaging fins, with the engaging fins having an engaging slot defined therebetween.

The wall section includes a sheet and a frame, wherein the sheet is provided to cover up the frame. The sheet and the frame include a bend defined therein. The sheet includes a plurality of folded sections formed therein. The wall section is received in the engaging slot. The connecting members and wall sections can be implemented to form a plurality of hexagonal storage rooms.

It is an objective of the present invention to provide a hexagonal storage room so that cylindrical objects can be steadily stored.

It is another objective of the present invention to provide a storage rack that rests on the floor stably.

It is yet another objective of the present invention to provide the storage rack with a strong structure.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
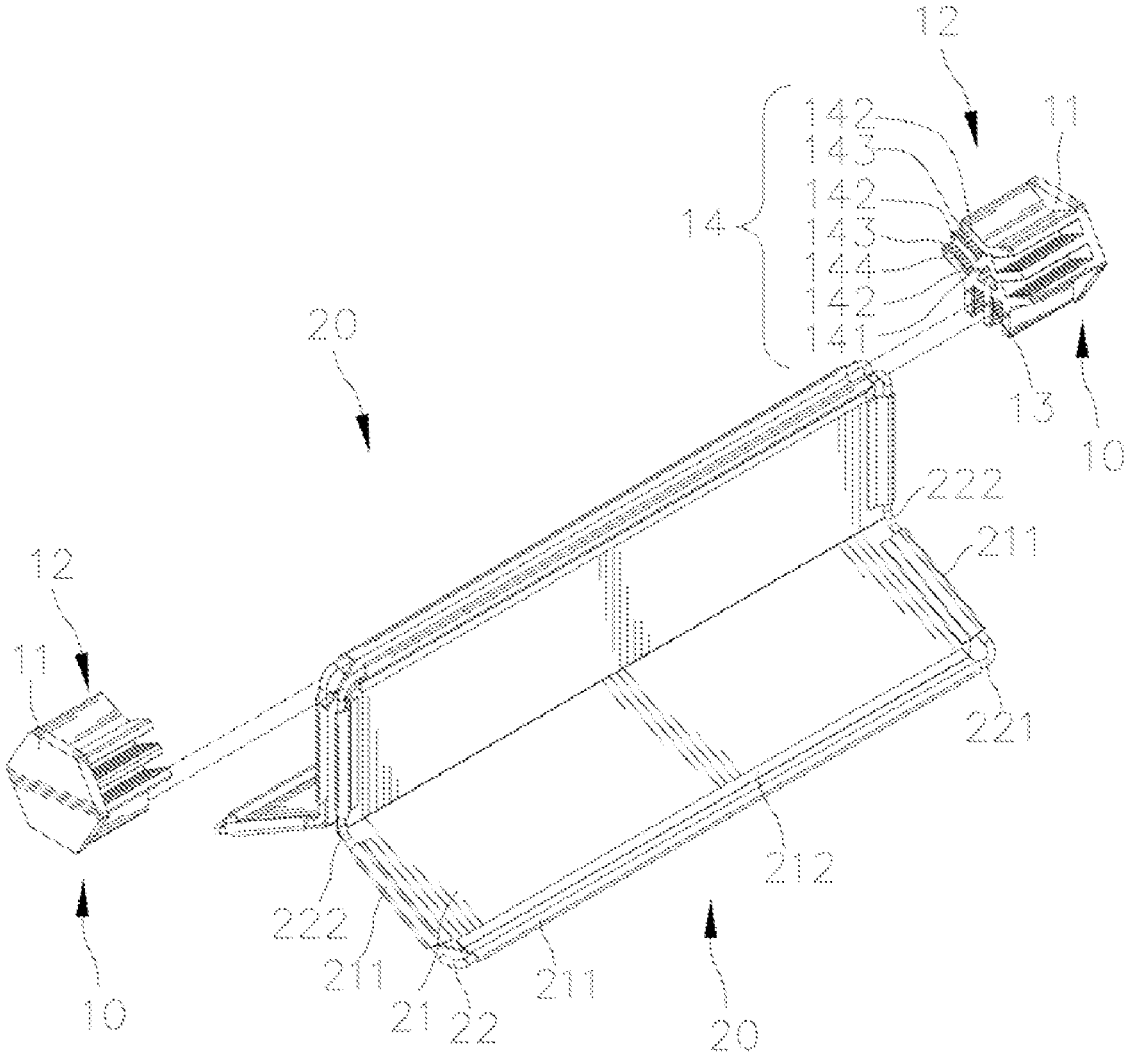
FIG. 1 is a perspective view illustrating the assembly of the storage rack in accordance with the present invention diagrammatically.

FIG. 1 illustrates assembly of a storage rack 1 in accordance with the invention. The storage rack 1 includes a plurality of connecting members 10 and wall sections 20. Each wall section 20 is adapted for the reception of two connecting members 10. Each connecting member 10 includes a hexagonal base II from which three E-shaped engaging portions 14 defining an engaging end 12 project for allowing the wall sections 20 to be joined. The E-shaped engaging portions 14 are equally spaced on the base 11 and each include a bottom 141 and three engaging fins 142, with the bottoms 141 defining a triangle. The triangle is disposed in the center 13 of the engaging end 12. Since each engaging portion 14 includes three engaging fins 142, two engaging slots 143 are defined. Each engaging slot 143 has a plurality of bulges 144 defined therein so that the wall sections 20 are efficiently clipped within the engaging slots 143 of the engaging portions 14.

The wall section 20 includes a sheet 21 and a frame 22. The sheet 21 is provided to cover up the frame 22 and includes a plurality of folded sections 211 and overlapped sections 212 defined therein. The frame 22 comprises two first frame sections 221 and two second frame sections 222. The second frame sections 222 are angled with the two distal ends thereof defining a 120 degree included angle.

Figure 2:
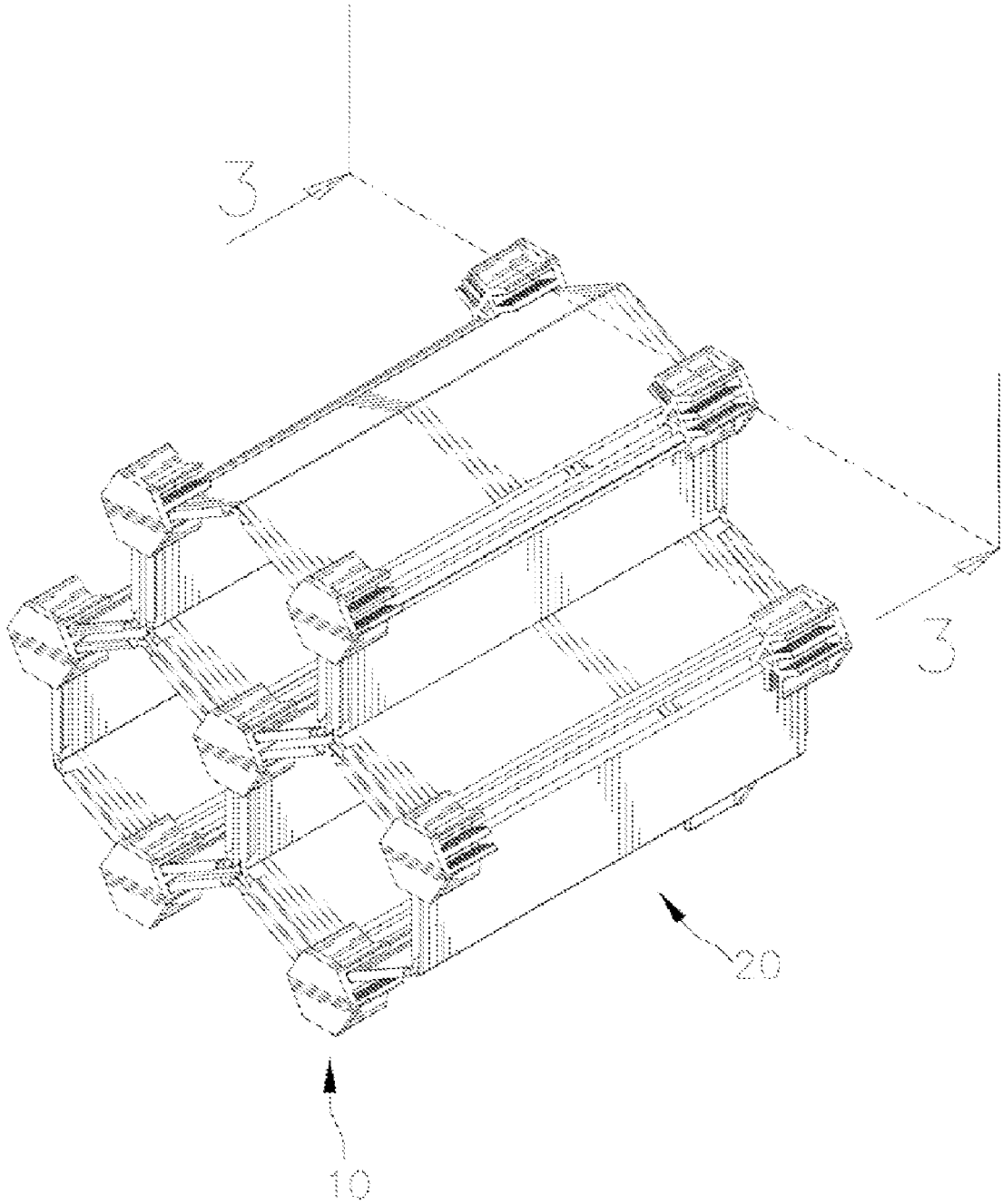
FIG. 2 is a perspective view of another embodiment of a storage rack in accordance with the invention.
Figure 3:
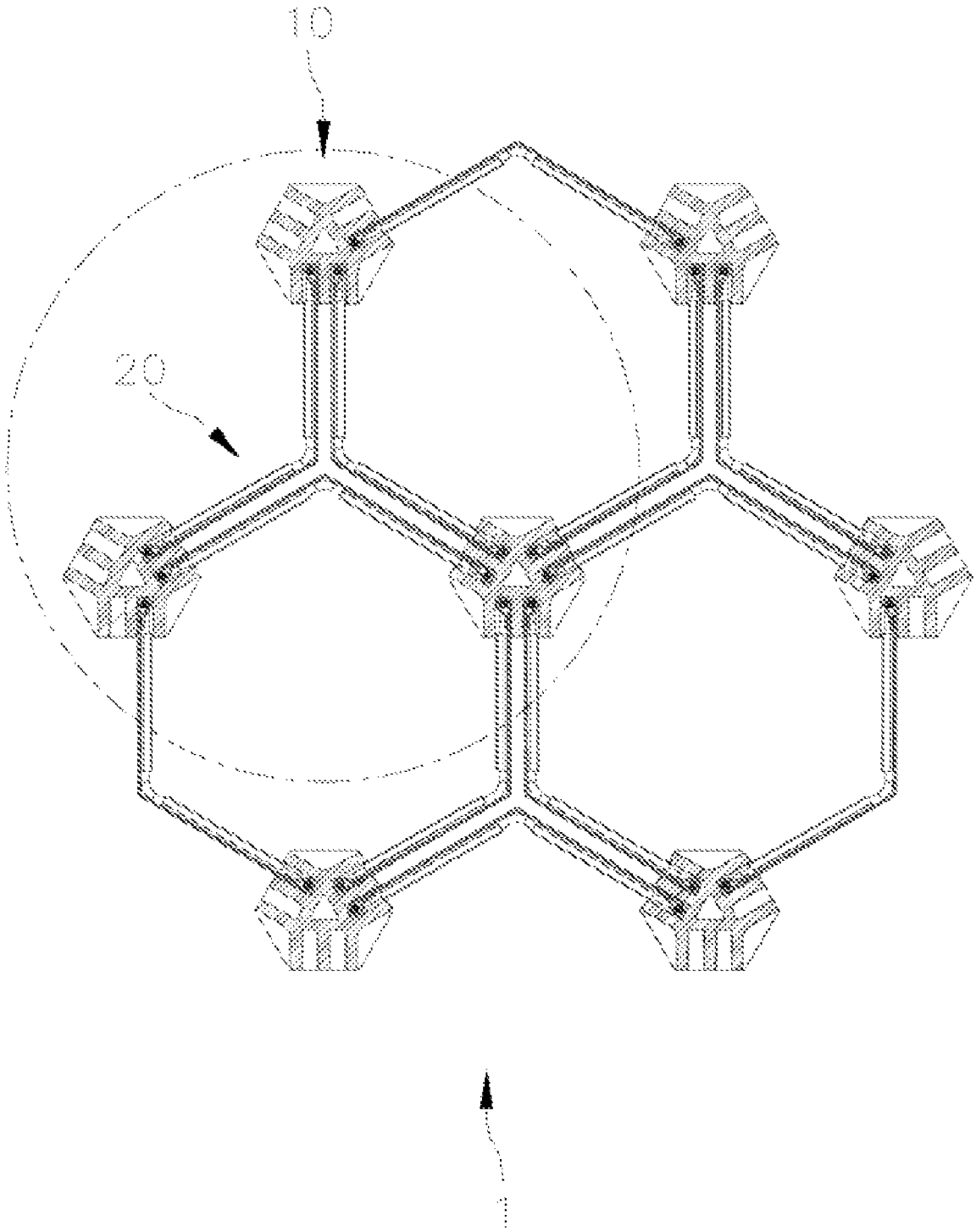
FIG. 3 is a cross-sectional view taken along line 3-3 of FIG. 2.
Figure 4:
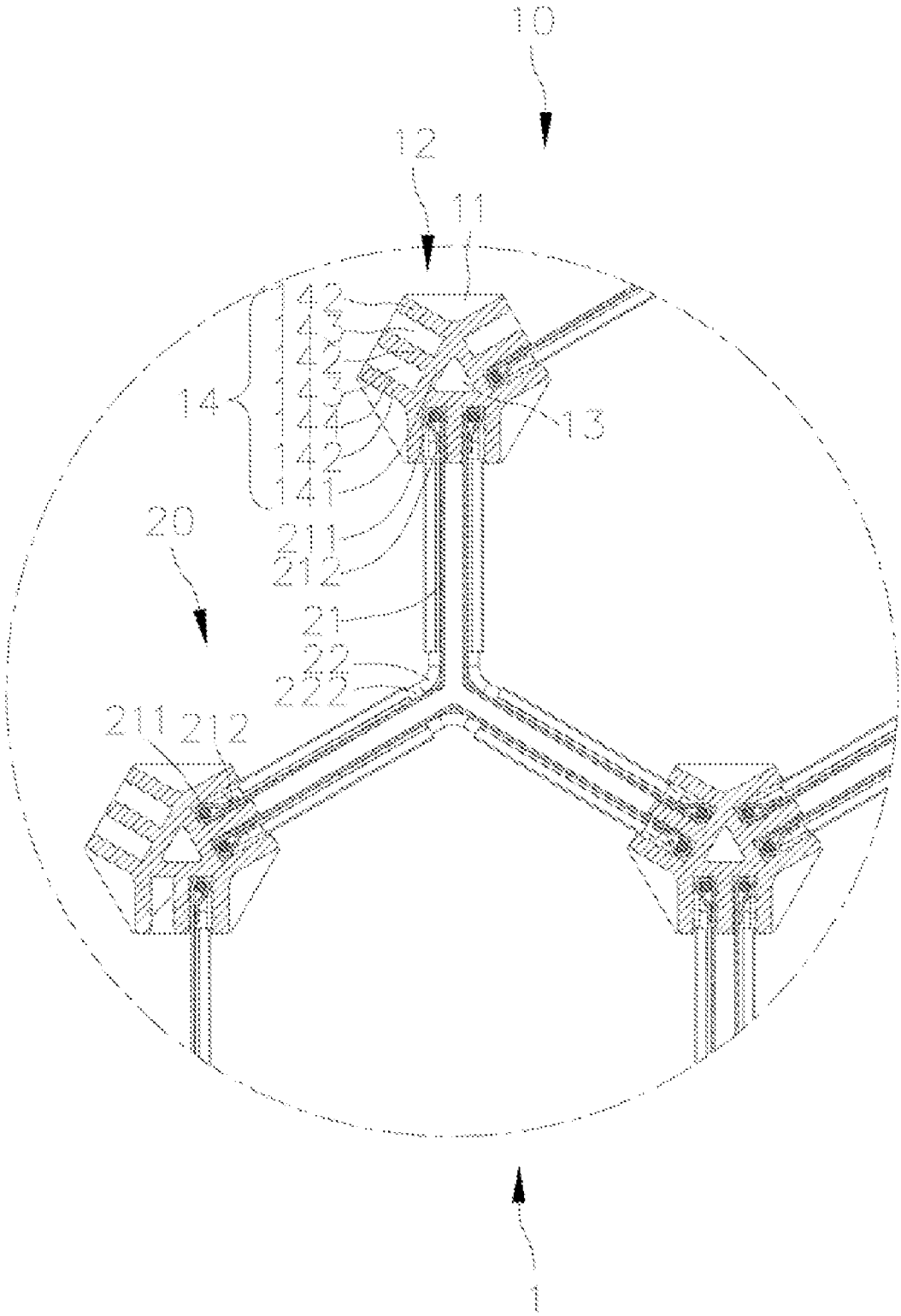
FIG. 4 is a fragmentary enlarged view of FIG. 3.

Referring to FIGS. 2 through 4, in a first embodiment of the storage rack 1, the corner of the wall section 20 or more specifically the folded section 211 of the sheet 21 is partially received within the engaging slot 143 of the engaging portion 14. Three wall sections 20 and six connecting members 10, with three being disposed at the front side and three at the back side respectively, are implemented to form a hexagonal storage room.

Figure 5:
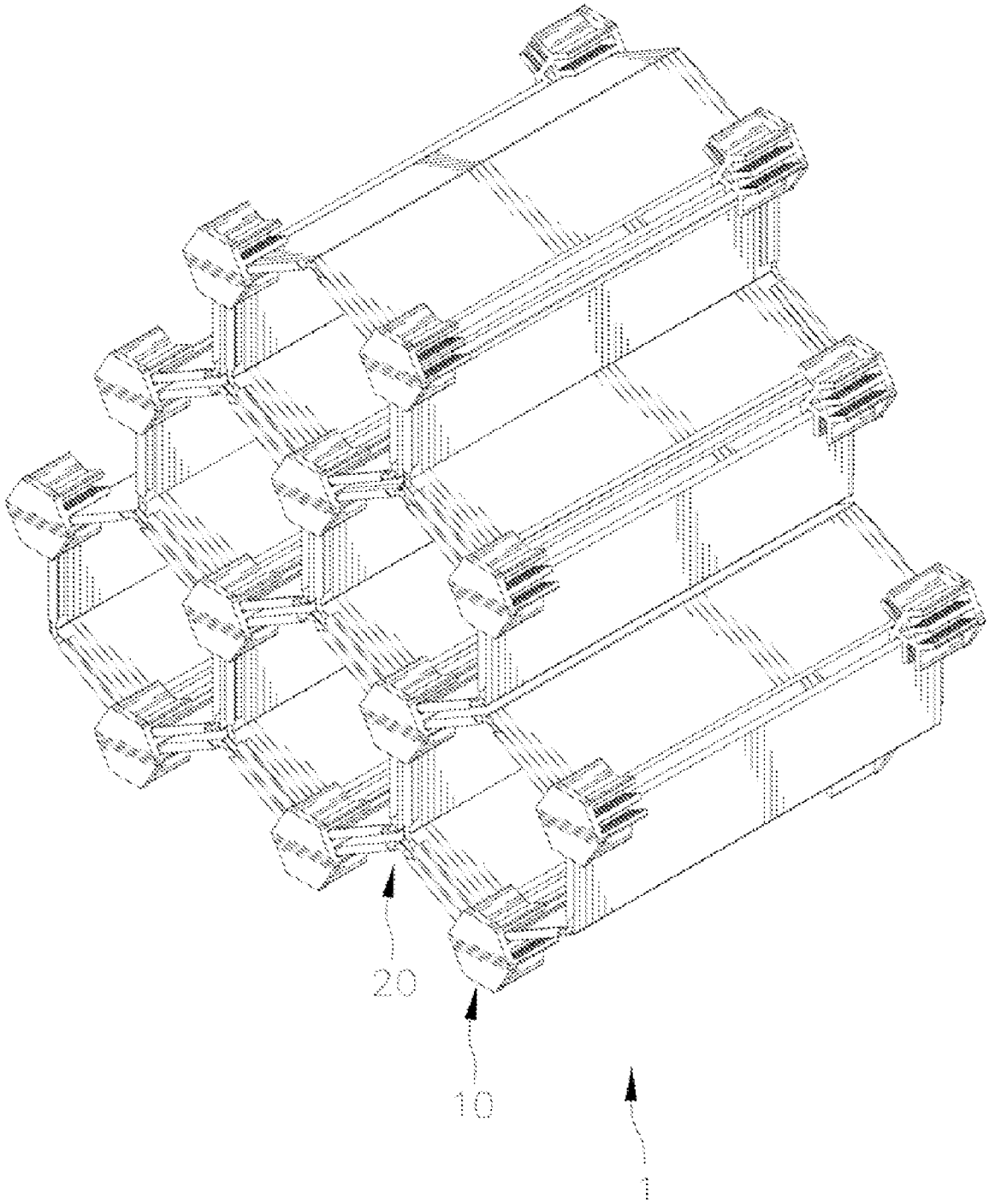
FIG. 5 is a perspective view of yet another embodiment of a storage rack in accordance with the invention.
Figure 6:
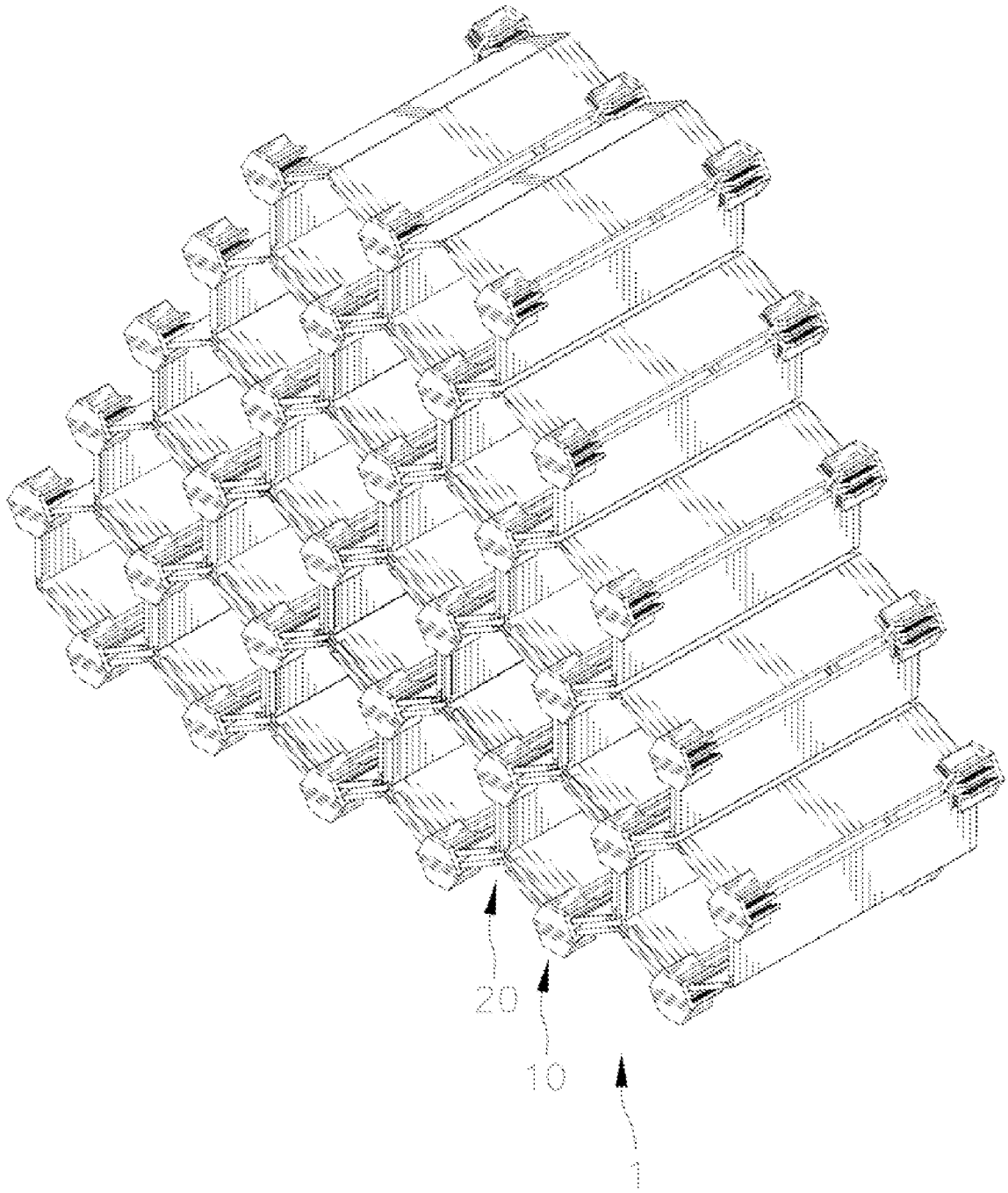
FIG. 6 is a perspective view of still another embodiment of a storage rack in accordance with the invention.

Alternate configurations of the storage rack 1 are depicted in FIGS. 5 and 6. It is noted that there is no restriction on the number of storage rooms constructed in the storage rack 1 in accordance with the invention.

In view of the foregoing, the storage rack 1 provides a hexagonal storage room so that cylindrical objects can be steadily stored. Furthermore, as the connecting member 10 falls flat on the floor, the storage rack 1 is in a stable position. Moreover, the wall section 20 is angled with two distal ends thereof defining a 120 degree angle so as to provide a strong structure.

While the specific embodiments have been illustrated and described, numerous modifications come to mind without significantly departing from the spirit of invention and the scope of invention is only limited by the scope of the accompanying claims.

What is claimed is:

1. A storage rack comprising:

a plurality of connecting members, with each connecting member including a substantially planar base and an engaging end, with the engaging end having three engaging portions with the engaging portions abutting against the substantially planar base, with each engaging portion comprising a plurality of engaging fins, with the plurality of engaging fins including engaging slots defined therebetween;

a plurality of wall sections, with each wall section including a sheet and a frame, with the sheet covering up the frame, with the sheet including a plurality of folded sections defined therein, and with the sheet and the frame having a bend defined therein, wherein each of the wall sections is received in a respective engaging slot of the plurality of connecting members, and with the plurality of connecting members and wall sections together forming a plurality of hexagonal storage rooms.

2. The storage rack as claimed in claim 1 wherein the base is hexagonal, and wherein the engaging portions disposed thereon are equally spaced.

3. The storage rack as claimed in claim 1 wherein the engaging end includes a triangle defined in a center, and each side of the triangle includes one of the three engaging portions projecting therefrom.

4. The storage rack as claimed in claim 1 wherein each engaging portion is E shaped and includes a bottom and three engaging fins.

5. The storage rack as claimed in claim 1 wherein each engaging slot has a plurality of bulges defined therein.

6. The storage rack as claimed in claim 1 wherein the frame includes two first frame sections and two second frame sections.

7. The storage rack as claimed in claim 1 wherein the sheet and the frame include a 120 degree included angle defined at the bend.

8. The storage rack as claimed in claim 1 wherein each folded section includes an overlapped section.

* * * * *